United States Patent [19]

Agrawal et al.

[11] Patent Number: 4,472,270

[45] Date of Patent: Sep. 18, 1984

[54] BENEFICIATION OF ORES

[75] Inventors: Anil K. Agrawal, Somerset; Ross A. Kremer, Ringoes; George J. Weckesser, Plainsboro, all of N.J.

[73] Assignee: Mobil Oil Corporation, New York, N.Y.

[21] Appl. No.: 495,567

[22] Filed: May 18, 1983

[51] Int. Cl.[3] ..... B03D 1/14

[52] U.S. Cl. ..... 209/166; 209/167; 252/61

[58] Field of Search ..... 209/166, 167; 252/61

[56] References Cited

U.S. PATENT DOCUMENTS

| | | | |
|---|---|---|---|
| 2,105,807 | 1/1938 | Crago et al. | 209/167 |
| 2,569,417 | 9/1951 | Jayne et al. | 209/166 |
| 2,839,191 | 6/1958 | Monson et al. | 209/166 |
| 3,363,758 | 1/1968 | Cronberg | 209/166 |
| 3,817,972 | 6/1974 | Grannen | 209/166 |
| 4,234,414 | 11/1980 | Hefner | 209/166 |
| 4,287,052 | 9/1981 | Hefner | 209/166 |
| 4,319,987 | 3/1982 | Shaw | 209/166 |
| 4,358,368 | 11/1982 | Hellsten et al. | 209/167 |
| 4,364,824 | 12/1982 | Snow | 209/167 |
| 4,377,472 | 3/1983 | Allen | 209/166 |

*Primary Examiner*—Bernard Nozick

*Attorney, Agent, or Firm*—Alexander J. McKillop; Michael G. Gilman; Claude E.. Setliff

[57] ABSTRACT

The invention provides a new and improved process for beneficiating ores which comprises a single cationic float using an etherdiamine as the cationic collector following washing the feed with aqueous alkali metal silicate.

17 Claims, No Drawings

BENEFICIATION OF ORES

BACKGROUND OF THE INVENTION

1. Field of the Invention

The invention relates to the beneficiation of ores. More particularly it relates to the beneficiation of phosphate ores, and still more particularly to an improved benefication process which comprises use of an etherdiamine, as a selective collector in a single flotation step, in combination with an aqueous alkali metal silicate wash of the feed prior to flotation.

2. Discussion of the Prior Art

Phosphate ore is found in various places in nature, and it contains a valuable raw material for producing many products, principally fertilizer. The most useful constituent of the ore is calcium fluorophosphate; those of no value include calcium carbonate, carbonaceous materials, heavy minerals, siliceous materials such as silica, and clay. Removal of these valueless materials is necessary and has been the subject of extended research.

As everyone in the phosphate mining and recovery arts knows, before about 1930 recovery of such phosphate was little better than 20%. About this time, the flotation system was developed by the predecessor to International Minerals Corporation. Flotation separated phosphate rock from clays and the like by treating them with chemicals to cause them to float. This was done by frothing, or creating air bubbles, to which the phosphate could cling for floating.

As taught in U.S. Pat. No. 3,817,972, partial concentration is first employed to remove phosphate and this is followed by two separate beneficiation steps. The first one is the fatty acid flotation of phosphate values using an acid and a strong base (caustic soda or ammonia) in combination with a petroleum fraction such as fuel oil. The fraction obtained, or rougher concentrate, still contains considerable siliceous material and, after deoiling this rougher concentrate, is treated in a second flotation using long chain fatty acid amines or salts thereof. This has been used since about 1942 and still is the standard procedure in use in the phosphate recovery industry. No art is known that teaches or suggests using an etherdiamine in a single flotation step.

U.S. Pat. No. 4,227,996 teaches a method of beneficiation in which an ether tri- or tetramline is used in a beneficiating process having at least two floats.

One-step flotation or one-agent methods using amines are known. For example, U.S. Pat. No. 2,313,260 discloses a method for preferentially floating the siliceous material away from phosphate ores using octadecylamines. However, the pH had to be maintained at a high level (8.5–11), and the ground one was preferably conditioned with alkaline solution, washed with water and slurried prior to flotation. Also, U.S. Pat. No. 4,227,996 is directed toward flotation with a single agent, i.e., a polyamine adduct of a long chain monoepoxide and a polyalkylene polyamine, and this product may then be reacted with water. One product disclosed has the formula:

$$\begin{array}{c} \quad\quad\quad\quad\quad\quad OH \\ \quad\quad\quad\quad\quad\quad | \\ \quad\quad\quad\quad CH_2CHCH_2OCH_2(CH_2)_4CH_3 \\ \quad\quad\quad\quad\quad\quad | \\ NH_2-(CH_2CH_2-N)_2-CH_2CH_2NH_2 \end{array}$$

The disadvantage of the patented process, however, is that at least two floats using the amine reagent are required for optimum recovery of phosphate values.

SUMMARY OF THE INVENTION

In accordance with this invention, there is provided a process for beneficiating ores, particularly phosphate ores, in a single flotation stage comprising treating a flotation feed with aqueous alkali metal silicate to remove clay and then floating the feed in the presence of a collector comprising an etherdiamine of the formula:

$$RO(CH_2)_xNH-(CH_2)_y-NH_2$$

wherein R is a $C_6$ to $C_{20}$ hydrocarbyl group, x is 2 to 4 and y is 2 to 4, and a petroleum oil such as a kerosene. R is preferably an alkyl group, but may be aryl, alkaryl, aralkyl, alkenyl, or cycloalkyl (e.g., cyclohexyl) groups. The aryl group or the aryl portion of alkaryl and aralkyl may have 10 to 14 carbon atoms, which includes phenyl, naphthyl and anthryl.

DESCRIPTION OF SPECIFIC EMBODIMENTS

In Florida and in other places, phosphate rock does, or may occur in sedimentary deposits below an overburden, the top layer of which is mostly sand. In the former, the zone between the bottom of the overburden and the phosphate deposit is referred to as the "leach zone". This is a zone of aluminum phosphate minerals (mainly wavellite and cradallite) which average the equivalent of 20 to 30% aluminum phosphate, with 5 to 15% clay and the rest sand. This zone is currently discarded. The matrix is about 15 feet thick and is currently the actively-mined zone. Below the matrix is a thin layer of clay (0 to 3 feet) on top of an approximately 200-foot layer of limestone. The limestone layer contains considerable phosphate deposit and it is considered to be the source rock of the phosphate deposit. The phosphate minerals were deposited originally from warm currents of ocean water. Subsequently, the deposits were reworked by submarine currents; even later they were weathered by streams and rainfall.

The matrix, which will vary greatly, is an unconsolidated mixture with a composition approximately one-third each of a fluorapatite (the main phosphate component), quartz sand and a mixture of clays. The clays present are primarily montmorillonite and attapulgite. Fluorapatite has the composition $Ca_5(PO_4)_3F$. The mineral present in the ore also contains carbonate and hydroxyl as part of the structure.

In processing the ore, about 70% of the phosphate is recovered from the matrix and about 20% is lost in the slimes as particles smaller than 150 mesh (105 micrometers). Another 10% is lost with the sand tailings from the flotation plant. The 70% of the phosphate recovered contains, among other things, large pebbles and concentrate from flotation. The amounts of these will vary greatly, depending upon the source of the deposit.

It is generally known that the common problems of separation are associated with the wide particle distribution of sand and phosphate in the flotation feed, and the presence of any unremoved clay. This distribution occurs even though the feed is segregated into two sizes. While the fatty acid float is selective, there is a tendency for the larger phosphate particles to settle too quickly and thus are lost as tailings. The fine sand also tends to float with the phosphate rock.

Normally in conventional commercial operations from about 0.5 to about 1.5 pound of fatty acid collector per ton of flotation feed is used in the first or fatty acid flotation step, along with about 3 times as much petroleum fraction, i.e., from about 1.5 pounds to about 4.5 pounds per ton thereof. With optimum use of these reagents, one can obtain a recovery of up to about 80–85% by weight of the BPL in the flotation feed. This represents about the maximum one can attain with this reagent system in this step. When the amount of reagents used in the fatty acid flotation step is added to those used in the amine, or second flotation, the total quantity of reagent is quite substantial and accounts for a significant part of the total cost of processing phosphate ore.

The two-stage process is time consuming, from the standpoints of multiple reagentizing and flotation steps. Process control can also be troublesome due to reagent proportioning and pH control. Our process avoids most of the problems associated with conventional phosphate recovery methods, and, in addition, eliminates the need for multiple flotation steps as required in U.S. Pat. No. 4,227,996.

In general terms, the process of this invention involves the following steps. After the phosphate rock is mined, it is conveyed to the beneficiating plant by slurrying in water and pumping. Once at the processing plant, the ore is classified and pebble products recovered by putting it through a series of screens, washers, cyclones and hydrosizers to produce a flotation feed. This feed is treated with a solution of aqueous alkali metal silicate, rinsed with water and is then floated in the presence of the amine of this invention and a petroleum fraction in a flotation cell. In the flotation of washed feed, stable foam is not formed; however, formation of stable foam in flotation of unwashed feed makes this process inoperable.

The amine can be used at from about 0.1 to about 1.0, preferably about 0.15 to about 0.6, lbs. per ton of flotation feed. The petroleum fraction is used in concentrations of about 1 to 3 times that of the amine. The amount of alkali metal silicate required will range from about 0.3 to about 1.5, preferably about 0.5 to about 1.0, lbs. per ton of feed. Aqueous wash solutions of the metal silicates generally contain from about 0.006% to about 0.03%, preferably about 0.01% to about 0.20%, by weight of the solution of the metal silicate.

The metal in the metal silicate is any of those set forth in Group IA of the Periodic Table. They include sodium, potassium and cesium.

The petroleum fraction useful in the hereindescribed phosphate flotation processes can be any of a number of products normally used in the phosphate industry. These include kerosene, or range oil, and the distillate fuel oils, including Nos. 1 through 6. Further, the term "petroleum fraction" includes those oils whose properties are described on pages 11–41 through 11–56 of the Petroleum Processing Handbook, McGraw-Hill Book Company (1967), incorporated herein by reference.

Having broadly described the invention, following are illustrative and comparative Examples. It will be understood that the Examples are illustative only and that they are not intended to limit the invention.

EXAMPLES

The amine used was $C_{10}H_{21}OC_3H_6NHC_3H_6NH_2$.

Fine phosphate flotation feed (−35+150 mesh) used in Examples 1 and 4 were washed with 5 wt. % aqueous solution of sodium silicate to supply 0.7 lb. of silicate per ton of feed and were then washed with 1.9 tons of water per ton of feed. The feeds used in Examples 2, 3 and 5 were not washed with metal silicate. Both washed and unwashed feed were subjected to flotation in the presence of the amine and of kerosene, at concentrations shown in Table 1.

Examples 1, 2 and 3 of Table 1 were run using a flotation feed having 32% BPL; the feed used for Examples 4 and 5 had 23% BPL.

TABLE 1

| Example | Amine Loading** Lb/ton of feed | Kerosene Loading lb/ton of feed | Concentrate Grade, BPL | Phosphate Recovery % | Phosphate Recovery Foam |
|---|---|---|---|---|---|
| 1 | 0.15 | 0.30 | 72.8 | 96.2 | No |
| 2 | 0.40 | 0.20 | 70.2 | 94.8 | Yes* |
| 3 | 0.50 | 0.35 | 70.2 | 97.8 | Yes* |
| 4 | 0.30 | 0.60 | 71.2 | 91.9 | No |
| 5 | 0.60 | 0.30 | 26.2 | 99.5 | Yes* |

*Large quantity of stable foam, making process commercially inoperative
**Added after washing

What is claimed is:

1. A process for beneficiating an ore in a single flotation stage comprising washing a flotation feed with an aqueous alkali metal silicate solution, and then floating the washed feed under froth flotation conditions in the presence of an amine of the formula:

$$RO(CH_2)_xNH—(CH_2)_y—NH_2$$

wherein R is a $C_{10}$ to $C_{20}$ hydrocarbyl group, x is 2 to 4 and y is 2 to 4, and a petroleum fraction.

2. The process of claim 1 wherein said ore is phosphate ore, said amine is $C_{10}H_{21}OC_3H_6NHC_3H_6NH_2$, used at 0.15 pound per ton of feed and said petroleum fraction is kerosene used at 0.3 pound per ton of feed.

3. The process of claim 1 wherein said ore is phosphate ore, said amine is $C_{10}H_{21}OC_3H_6NHC_3\ H_6NH_2$, used at 0.30 pound per ton of feed and said petroleum fraction is kerosene used at 0.60 pound per ton of feed.

4. The process of claim 1 wherein the alkali metal silicate is sodium silicate.

5. The process of claim 1 wherein said ore is phosphate ore.

6. The process of claim 1 wherein said feed is a nominal −35+150 mesh.

7. The process of claim 6 wherein said ore is phosphate ore.

8. The process of claim 1 wherein said petroleum fraction is kerosene.

9. The process of claim 2 wherein said ore is phosphate ore.

10. The process of claim 1 wherein said amine is used at a concentration of from about 0.1 pound to about 1.0 pound per ton of feed.

11. The process of claim 10 wherein said ore is phosphate ore.

12. The process of claim 10 wherein said concentration is from about 0.15 pound to about 0.6 pound of amine per ton of feed.

13. The process of claim 12 wherein said ore is phosphate ore.

14. The process of claim 1 wherein said hydrocarbyl group is an alkyl, aryl, aralkyl, alkaryl, alkenyl or cycloalkyl group.

15. The process of claim 14 wherein said ore is phosphate ore.

16. The process of claim 14 wherein said hydrocarbyl group is an alkyl group.

17. The process of claim 16 wherein said ore is phosphate ore.

* * * * *

UNITED STATES PATENT AND TRADEMARK OFFICE

CERTIFICATE OF CORRECTION

PATENT NO. : 4,472,270

DATED : September 18, 1984

INVENTOR(S) : Anil K. Agrawal, Ross A. Kremer and George J. Weckesser

It is certified that error appears in the above-identified patent and that said Letters Patent is hereby corrected as shown below:

In Col. 1, line 55, change "one" to --ore--

In Claim 9, change "2" to --8--.

Signed and Sealed this

*Sixteenth* Day of *April 1985*

[SEAL]

*Attest:*

DONALD J. QUIGG

*Attesting Officer*

*Acting Commissioner of Patents and Trademarks*